US007157986B1

(12) United States Patent
Wu et al.

(10) Patent No.: US 7,157,986 B1
(45) Date of Patent: Jan. 2, 2007

(54) THREE-DIMENSIONAL BALUN

(75) Inventors: Pei-Si Wu, Taipei (TW); Tian-Wei Huang, Taipei (TW); Huei Wang, Taipei (TW)

(73) Assignee: National Taiwan University, Taipei (TW)

( * ) Notice: Subject to any disclaimer, the term of this patent is extended or adjusted under 35 U.S.C. 154(b) by 45 days.

(21) Appl. No.: 11/150,694

(22) Filed: Jun. 11, 2005

(51) Int. Cl.
*H01P 5/10* (2006.01)
*H01P 5/18* (2006.01)

(52) U.S. Cl. ..... 333/26; 333/25; 333/116

(58) Field of Classification Search ..... 333/25, 333/26, 109, 116
See application file for complete search history.

(56) References Cited

U.S. PATENT DOCUMENTS 5,534,830 A * 7/1996 Ralph ..... 333/128
6,204,736 B1 * 3/2001 Logothetis ..... 333/26
6,515,556 B1 * 2/2003 Kato et al. ..... 333/116
7,027,795 B1 * 4/2006 Ji ..... 455/333

* cited by examiner

*Primary Examiner*—Dean Takaoka

(57) ABSTRACT

A three-dimensional balun is disclosed by laminating alternate layers of conductor and dielectric substrate on top of each other to create a microwave circuit. The laminated layers are constructed in a transmission line configuration, corresponding to an equivalent circuit, wherein the first and third transmission lines, the fifth and seventh transmission lines, the second and fourth transmission lines, and the sixth and eighth transmission lines are pairs of coupling lines; one end of the sixth transmission line is defined as an input; one end of the seventh transmission line is defined as a first output; one end of the eighth transmission line is defined as a second output. When signals close to the center frequency of the operating balun are input from the unbalanced side, the signals are converted and then output through the first and second outputs having the same amplitude and producing 180-degree phase shifts.

10 Claims, 4 Drawing Sheets

THREE-DIMENSIONAL BALUN

BACKGROUND OF THE INVENTION

1. Field of the Invention

The present invention relates to a three-dimensional balun, and in particular to a multi-layer microwave circuit that is implemented in high density microwave integrated circuits for linking an unbalanced circuit to a balanced circuit or vice versa.

2. The Related Art

Conventional microwave circuits or balanced-unbalanced converters are often referred to as baluns, commonly used in mixers, push-pull amplifiers, and voltage-controlled oscillators, and phase shifters, and antennas. A typical balun converts balanced signals to unbalanced signals, or from unbalanced signals to balanced signals in microwave or milliwave transmissions.

For instance, when signals close to the center frequency of the operating balun are input from the unbalanced side, the signals are converted and then output through two outputs having the same amplitude and producing 180-degree phase shifts.

The baluns can be distinguished by types. A wire-wound transformer provides an excellent balun covering frequencies from low kHz to GHz. An active type balun that incorporates a pre-amplifier is able to provide broad bandwidth and high gain, but often accompanied by high spurious output level and extra power consumption. A lumped type balun, though saves on circuit space employing lumped inductors and capacitors, is limited in bandwidth and can only support below 10 GHz.

A Marchand type balun provides large bandwidth, good isolation, and low spurious output level. The Marchand type balun is more tolerant of low coupling ratio in the even mode than the coupled line balun, and has a wider bandwidth. A rat-race coupler is commonly used for microwave frequencies with bandwidths up to 10–20%. However, the Marchand and rat-race baluns have to use quarter-wavelength transmission lines, thus taking up more circuit space.

In these aspects, the three-dimensional balun according to the present invention substantially reduces or obviates the limitations and disadvantages of the prior art. This new approach is to build three-dimensional baluns by laminating multiple microwave circuit layers on top of each other. The actual signal transmission lines are embedded in the first layer, while the upper layers are in a transmission line configuration.

SUMMARY OF THE INVENTION

The primary objective of the present invention is to provide a three-dimensional balun having a single-ended port on one side and two differential ports on opposite side for microwave and milliwave transmissions.

The secondary objective of the invention is to provide a three-dimensional balun that is capable of using multiple transmission lines to construct a vertical circuit to reduce the circuit space requirements for the miniature integrated circuits.

The tertiary objective of the invention is to provide a three-dimensional balun using low-temperature co-fired ceramic technology or FR4 substrates, so as to reduce the production costs and facilitates batch production of the miniature integrated circuits.

To attain the above-mentioned objectives, the vertical circuit is composed of alternate layers of conductor and dielectric substrate, and the multi-layer circuit is in transmission line configuration, corresponding to an equivalent circuit shown in FIG. 1, where the first, second, fifth and sixth transmission lines are connected; the third and seventh transmission lines are connected; the fourth and eighth transmission lines are connected; and the third and fourth transmission lines are connected to ground.

The equivalent circuit shown in FIG. 1 is constructed in such a way that the first and third transmission lines, the fifth and seventh transmission lines, the second and fourth transmission lines, and the sixth and eighth transmission lines are pairs of coupling lines.

The equivalent circuit is also characterized in that one end of sixth transmission line is defined as an input terminal, and one end of seventh transmission line is defined as a first output terminal, and that one end of eighth transmission line is defined as a second output terminal, such that when signals close to the center frequency of the operating balun are input from the unbalanced side, the signals are converted and then output through the first and second output terminals having the same amplitude and producing 180-degree phase shifts.

These and other features of novelty that characterize the invention are pointed out with particularity in the claims annexed to and forming a part of this disclosure. For a better understanding of the invention, the operating advantages and the specific objectives attained by its uses, references should be made to the accompanying drawings and descriptive matter illustrated in preferred embodiments of the invention.

DETAILED DESCRIPTION OF THE PREFERRED EMBODIMENT

The more important features of the invention have thus been outlined, rather broadly, so that the detailed description thereof that follows may be better understood, and in order that the present contribution to the art may be better appreciated.

Additional features of the invention will be described hereinafter, which will form the subject matter of the claims appended hereto.

Figure 1:
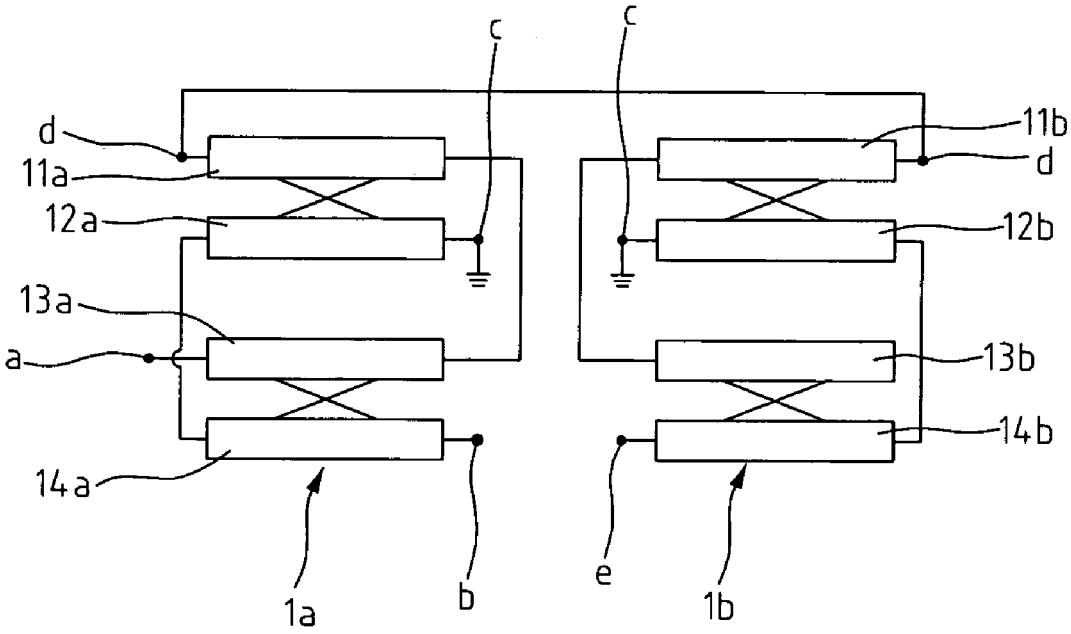
FIG. 1 is a schematic view of an equivalent circuit of a three-dimensional balun in accordance with the present invention.

Referring to FIG. 1, the three-dimensional balun is a multi-layer circuit structure, which corresponds to an equivalent circuit shown in FIG. 1 having two matching coupled lines: a first coupling component 1*a* and a second coupling component 1*b*. The first coupling component 1*a* includes multiple transmission lines: a transmission line 11*a*, a transmission line 12*a*, a transmission line 13*a*, and a transmission line 14*a*; and the second coupling component 1*b* includes multiple transmission lines: a transmission line 11*b*, a transmission line 12*b*, a transmission line 13*b*, and a transmission line 14*b*.

The equivalent circuit of the three-dimensional balun is constructed in such a way that the transmission lines 13*a*, 11*a* are connected in series; and the transmission lines 11*b* and 13*b* are connected in series; the transmission lines 14*a*, 12*a* are connected in series; and the transmission lines 12*b*, 14*b* are connected in series; and also the transmission lines 11*a*, 11*b* are mutually connected in series.

The equivalent circuit is also characterized in that the transmission lines 11*a*, 12*a*, the transmission lines 13*a*, 14*a*, the transmission lines 11*b*, 12*b*, and the transmission lines 13*b*, 14*b* are pairs of coupling lines respectively.

The equivalent circuit is also characterized in that one end of the transmission line 13*a* other than the one used for interlayer connection is defined as terminal a; one end of the transmission line 14*a* other than the one used for interlayer connection is defined as terminal b; one end of the transmission line 12*a* and transmission line 12*b* are both defined as terminal c and connected to ground; and one end of the transmission line 11*b* and one end of the transmission line 11*a* are both defined as terminal d, through which the transmission line 11*b* and transmission line 11*a* are mutually connected to each other; and one end of the transmission line 14*b* other than the one used for interlayer connection is defined as terminal e.

An exploded and perspective view of the vertical circuit is presented showing the relative arrangement of the elements thereof, where the size and thickness of certain elements have been somewhat exaggerated for clarity.

Figure 2:
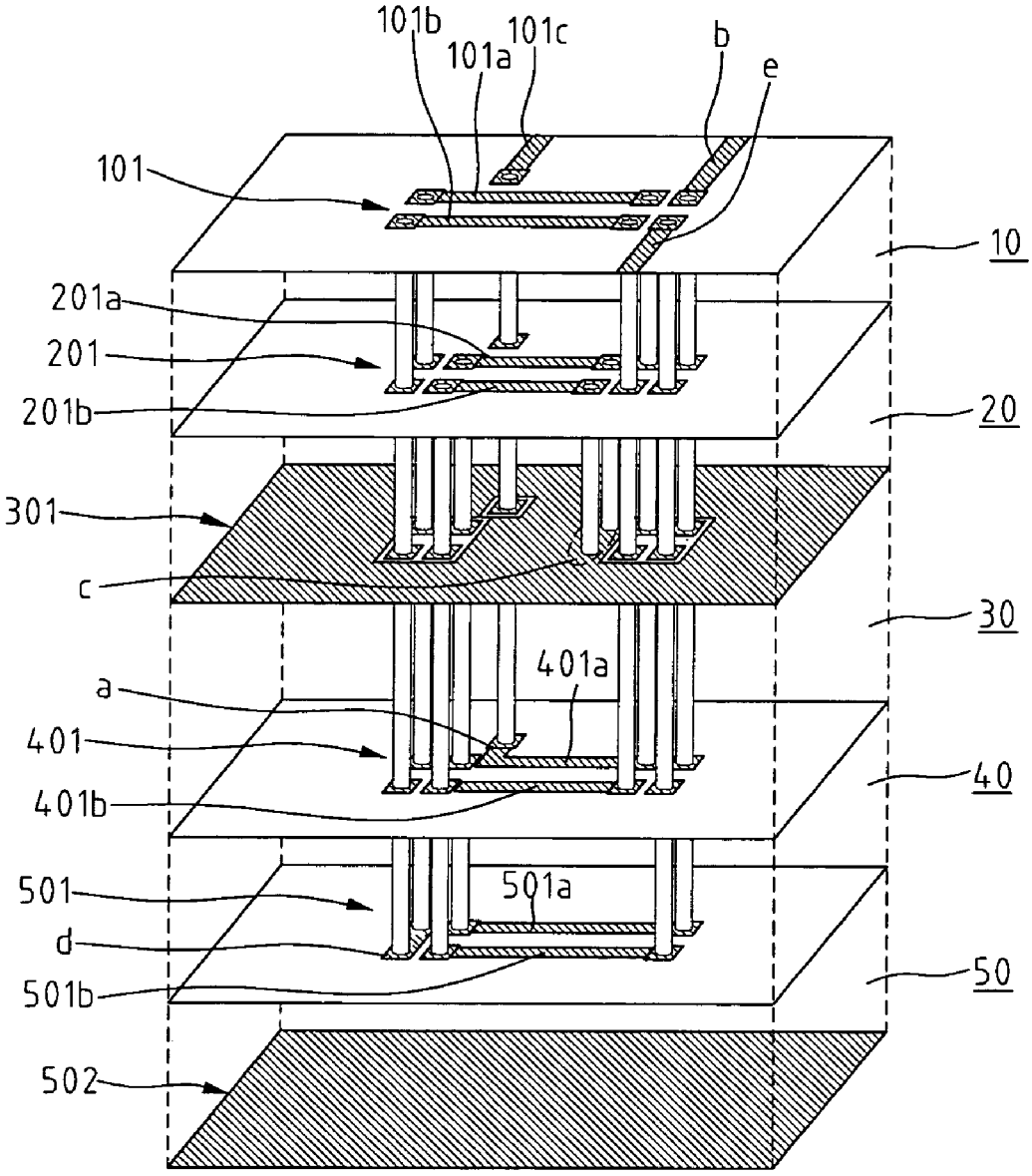
FIG. 2 is an exploded and perspective view of the three-dimensional balun as implemented by a preferred embodiment of the invention.

Referring to FIG. 2, the three-dimensional balun is composed of five layers of dielectric substrates: a first dielectric substrate layer 10, a second dielectric substrate layer 20, a third dielectric substrate layer 30, a fourth dielectric substrate layer 40, and a fifth dielectric substrate layer 50, in that order from top to bottom. The vertical circuit comprises a first coupling component 1*a* and a second coupling component 1*b*, corresponding to the equivalent circuit shown in FIG. 1.

The vertical circuit is characterized in that the dielectric substrate layers 10, 20, 30, 40, 50 are planar plates each embedded with a conductor layer on the top surface.

Referring to FIG. 2, the multi-layer circuit as implemented in the preferred embodiment is constructed using multiple dielectric substrate layers and ground plates.

The vertical circuit is also characterized in that the first dielectric substrate layer 10, second dielectric substrate layer 20, fourth dielectric substrate layer 40, and fifth dielectric substrate layer 50 are respectively metal plated on the top surface and respectively shaped to form a first circuit topology 101, a second circuit topology 201, a third circuit topology 301, and a fourth circuit topology 401 The top surface of the third dielectric substrate layer 30 is metal plated to form a first ground electrode 301, and the bottom surface of the fifth dielectric substrate layer 50 is metal plated to form a second ground electrode 502. The combined circuit action of the vertical circuit shall correspond to that of the equivalent circuit shown in FIG. 1.

More specifically, the first circuit topology 101 includes two matching transmission lines 101*a*, 101*b*, a terminal b, and a terminal e; the second circuit topology 201 includes two matching transmission lines 201*a*, 201*b*; the fourth circuit topology 401 includes two matching transmission lines 401*a*, 401*b* and a terminal a; and the fifth circuit topology 501 includes two matching transmission lines 501*a*, 501*b* and a terminal d, where one side of the third substrate is defined to be a first ground electrode 301 and one side of the fifth substrate is defined to be a second ground electrode 502.

The three-dimensional balun can be constructed with low-temperature co-fired ceramic LTCC technology or FR4 substrates. As such, the first dielectric substrate layer 10, second dielectric substrate layer 20, third dielectric substrate layer 30, fourth dielectric substrate layer 40, and fifth dielectric substrate layer 50 are formed by ceramic materials with high dielectric properties.

Figure 3A:
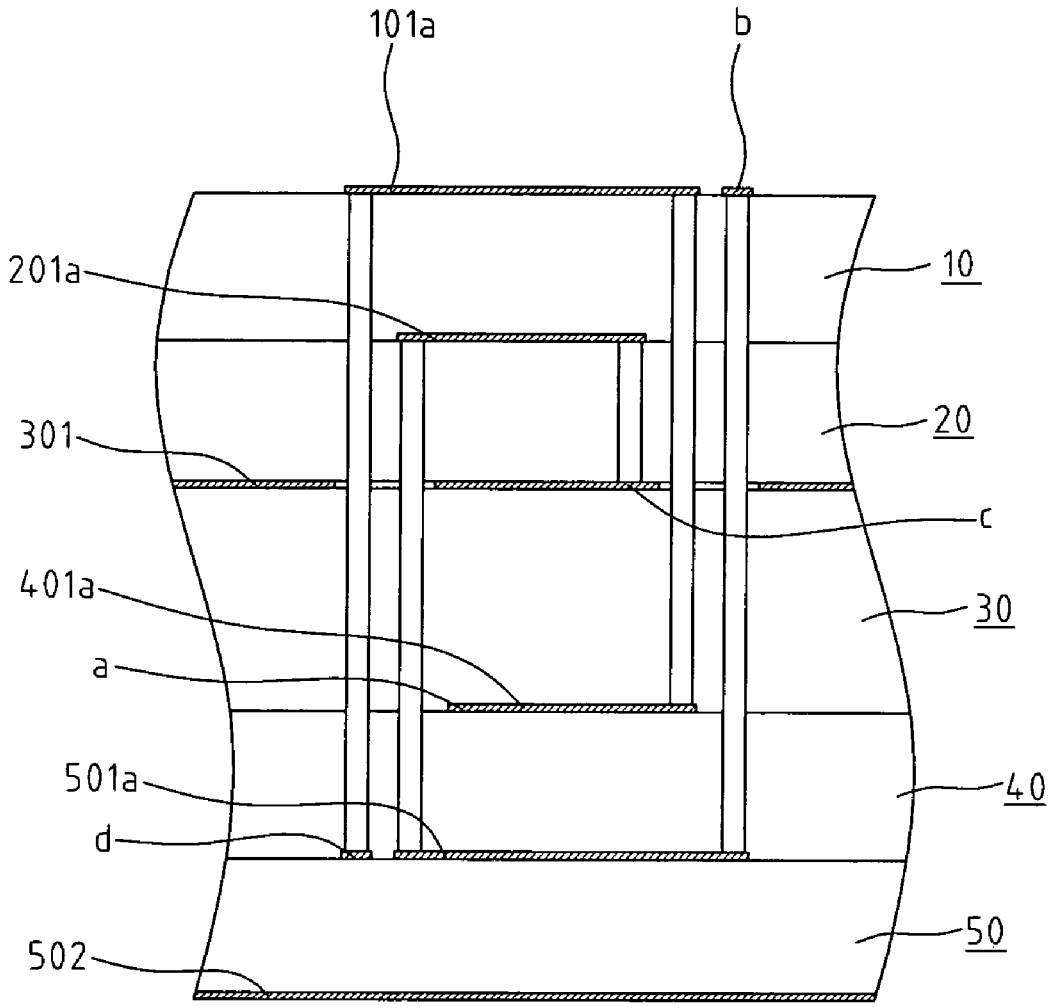
FIG. 3A is a sectional view of a portion of the laminated layers of the vertical circuit originally shown in FIG. 2.
Figure 3B:
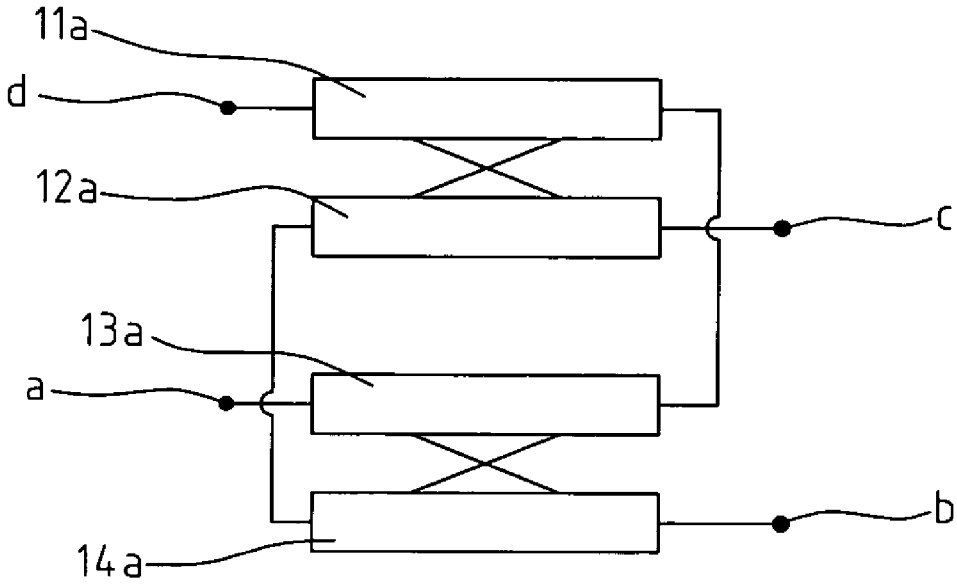
FIG. 3B is an equivalent circuit of a portion of the vertical circuit originally shown in FIG. 2.

Referring to FIG. 3A, the vertical circuit of the preferred embodiment is constructed using the same method as previously mentioned. The first coupling component 1*a* of the coupled line balun is constructed in such a way that one end of the transmission line 101*a* is extended downward through via core to be connected to one end of the transmission line 401*a* passing through the first dielectric substrate layer 10, the second dielectric substrate layer 20, the third dielectric substrate layer 30, and another end of the transmission line 101*a* is extended downward through via core to be connected to terminal d on the fifth dielectric substrate layer 50, passing through the first dielectric substrate layer 10, the second dielectric substrate layer 20, the third dielectric substrate layer 30, and the fourth dielectric substrate layer 40, where these two via cores are not connected to the first ground electrode 301.

The vertical circuit is also characterized in that one end of the transmission line 201*a* is extended downward through via core to be connected to the terminal c on the first ground electrode 301 passing through passing the second dielectric substrate layer 20; and another end of the transmission line 201*a* is extended downward through via core to be connected to one end of the transmission line 501*a*, passing through the second dielectric substrate layer 20, the third dielectric substrate layer 30, and the fourth dielectric substrate layer 40 and fifth dielectric substrate layer 50, where the via cores are not connected to the first ground electrode 301.

The vertical circuit is also characterized in that another end of the transmission line 501*a* is extended upward through via core to be connected to terminal b of the first dielectric substrate layer 10, passing through the fourth dielectric substrate layer 40, the third dielectric substrate layer 30, the second dielectric substrate layer 20, the first dielectric substrate layer 10, wherein the via core is not connected to the first ground electrode 301, and the transmission lines 101*a*, 201*a*, and the transmission lines 401*a*, 501*a* are pairs of coupling lines.

The vertical circuit is characterized in that the second coupling component 1*b* is formed using similar method as the first coupling component 1*a*. One end of the transmission line 101*b* is extended downward through via core to be connected to one end of the transmission line 401*b* passing through the first dielectric substrate layer 10, the second dielectric substrate layer 20, and the third dielectric substrate layer 30, and another end of the transmission line 101*b* is extended downward through via core to be connected to one end of the fifth dielectric substrate layer 50 defined as terminal d, passing through the first dielectric substrate layer 10, the second dielectric substrate layer 20, the third dielectric substrate layer 30, and the fourth dielectric substrate layer 40, where these two via cores are not connected to the first ground electrode 301; and the pair of transmission lines 101*a*, 101*b* becomes electrically connected through terminal d.

The vertical circuit is characterized in that one end of the transmission line 201*b* is extended downward through via core to be connected to part of the first ground electrode 301 defined as terminal c passing through the second dielectric substrate layer 20; one end of the transmission line 201*b* is connected to one end of the transmission line 501*a* on the fifth dielectric substrate layer 50, passing through the second dielectric substrate layer 20, the third dielectric substrate layer 30, and the fourth dielectric substrate layer 40, where these two via cores are not connected to the first ground electrode 301.

The vertical circuit is characterized in that another end of the transmission line 501*b* is extended upward through via core to be connected to the first dielectric substrate layer 10 defined as terminal e, passing through the fourth dielectric substrate layer 40, the third dielectric substrate layer 30, the second dielectric substrate layer 20, the first dielectric substrate layer 10, where the via core is not connected to the first ground electrode 301, wherein the above circuit enables the transmission lines 101*b*, 201*b*, and the transmission lines 401*b*, 501*b* are pairs of coupling lines respectively.

Furthermore, another end of the transmission line 401*b* opposite to one end being defined as terminal a is connected to the top surface of the first dielectric substrate layer 10 through via core, forming an input terminal 10*c*, passing through the second dielectric substrate layer 20 and the first dielectric substrate layer 10, where the input terminal 101*c* is part of the first circuit topology 101 on the first dielectric substrate layer 10, but the via core is not connected to the first ground electrode 301.

The three-dimensional balun can be realized with the length of each transmission line set to be 1/2*n n is the number of layers excluding ground planes of a wavelength long at the center frequency, which is required to meet the impedance transformation specifications for coupled line balun.

With regard to the operation of unbalanced to balanced conversion, signals close to the center frequency of the operating balun entering at the input terminal 101*c* on the unbalanced side are converted and then output through the two output terminals b and e having the same amplitude and producing 180-degree phase shifts.

Alternatively, for the balanced to unbalanced conversion, signals close to the center frequency of the operating balun entering from two input terminals on the balanced side are converted and then output through the single-ended output terminal producing ±90 degree phase shifts.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A three-dimensional balun, comprising:

multiple conductor layers made of metal material and having a dielectric substrate layer interposed between every two conductor layers, where each conductor layer includes a circuit topology, and the dielectric substrate layers are planar plates, wherein the conductor layers are in transmission line configuration, in such a way that the first conductor layer includes first and second transmission lines, a first terminal, and a second terminal;

the second conductor layer includes third and fourth transmission lines;

the third conductor layer includes a ground electrode and a fifth terminal;

the fourth conductor layer includes fifth and sixth transmission lines, and a third terminal; and the fifth conductor layer includes seventh and eighth transmission lines, and a fourth terminal; and the sixth conductor layer is a ground electrode;

the three-dimensional balun characterized in that one end of the first transmission line is connected to one end of the fifth transmission line through a via core, passing through multiple interlayer dielectric substrates in between, while another end of the first transmission line is connected to the fourth terminal through a via core, passing through interlayer dielectric substrates in between, where these two via cores are not connected to the third and sixth conductor layers;

one end of the third transmission line is connected to one end of the fifth terminal through a via core, passing through multiple interlayer dielectric substrates in between, while another end of the third transmission line is connected to one end of the seventh transmission line through a via core, passing through interlayer dielectric substrates in between, where these two via cores joining two ends of the seventh transmission line are not connected to the third and sixth conductor layers;

one end of the second transmission line is connected to one end of the sixth transmission line through a via core, passing through interlayer dielectric substrates in between, while another end of the second transmission line is connected to the fourth terminal through a via core, passing through interlayer dielectric substrates in between, where these two via cores are not connected to the third and sixth conductor layers;

one end of the fourth transmission line is connected to the fifth terminal through a via core, passing through interlayer dielectric substrates in between, while another end of the fourth transmission line is connected to one end of the eighth transmission line through a via core, passing through interlayer dielectric substrates in between, where these two via cores disposed on two ends of the eighth transmission line are not connected to the third and sixth conductor layers;

the first and third transmission lines, the fifth and seventh transmission lines, the second and fourth transmission lines, and the sixth and eight transmission lines form pairs of coupling lines respectively; and one end of the sixth transmission line being defined as the third terminal is to be an input port, passing through interlayer dielectric substrates, where the input port and the via core are not connected to the third and sixth conductor layers.

2. The three-dimensional balun as claimed in claim 1, wherein the balun is composed of multiple conductor layers and dielectric substrate layers corresponding to an equivalent circuit, comprising:

a first transmission line, a second transmission line, a third transmission line, a fourth transmission line, a fifth transmission line, a sixth transmission line, a seventh transmission line and an eighth transmission line, wherein the third and fourth transmission lines are grounded; the fifth, first, second and sixth transmission lines are connected in series; the seventh and third transmission lines are connected in series; the fourth and eighth transmission lines are connected in series, in such a way that the first and third transmission lines, the fifth and seventh transmission lines, the second and fourth transmission lines, and the sixth and eighth transmission lines are pairs of coupling lines respectively.

3. The three-dimensional balun as claimed in claim 2, wherein when signals close to the center frequency of the operating balun are input from the unbalanced side, the signals are converted and then output through the first and second terminals having same amplitude and producing 180-degree phase shifts.

4. The three-dimensional balun as claimed in claim 2, wherein the balun is constructed with each of the transmission lines set to be about 1/(2*n) of a wavelength long at the center frequency, where n is the number of layers excluding ground planes.

5. The three-dimensional balun as claimed in claim 2, wherein the balun extends to n layers configuration, and the total transmission line length is about a wavelength long at the center frequency.

6. The three-dimensional balun as claimed in claim 2, wherein the dielectric substrate layers are formed from low-temperature co-fired ceramic (LTCC) and/or FR4 substrates.

7. A three-dimensional balun, comprising:

multiple conductor layers being made of metal materials and having a dielectric substrate layer interposed between every two conductor layers, where each conductor layer includes a circuit topology, and the dielectric substrate layers are planar plates, where the conductor layers are electrically connected through interconnecting vias to form pairs of matched coupler lines respectively, and alternate layers of conductor and dielectric substrate are constructed to form a vertical circuit corresponding to an equivalent circuit, comprising:

a first transmission line, a second transmission line, a third transmission line, a fourth transmission line, a fifth transmission line, a sixth transmission line, a seventh transmission line, and an eighth transmission line, wherein the third and fourth transmission lines are grounded; the fifth, first, second, and sixth transmission lines are connected in that order; the seventh and third transmission lines are connected; and the fourth and eighth transmission lines are connected, wherein the first and third transmission lines, the fifth and seventh transmission lines, the second and fourth transmission lines, and the sixth and eighth transmission lines are pairs of matched coupler lines respectively.

8. The three-dimensional balun as claimed in claim 7, wherein when signals close to the center frequency of the operating balun are input from the unbalanced side, the signals are converted and then output through the first and second terminals having same amplitude and producing 180-degree phase shifts.

9. The three-dimensional balun as claimed in claim 7, wherein the balun is constructed with each of the transmission lines set to be 1/(2*n) of a wavelength long at the center frequency to meet the impedance transformation requirements for coupled lines, where n is the number of layers excluding ground planes.

10. The three-dimensional balun as claimed in claim 7, wherein the dielectric substrate layers of the balun are formed from low-temperature co-fired ceramic (LTCC) and FR4 substrates.

* * * * *